US006531006B2

(12) United States Patent
Jin et al.

(10) Patent No.: US 6,531,006 B2
(45) Date of Patent: Mar. 11, 2003

(54) PRODUCTION OF HIGH STRENGTH ALUMINUM ALLOY FOILS

(75) Inventors: Iljoon Jin, Kingston (CA); Kevin Gatenby, Kingston (CA); Christopher Gabryel, Kingston (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/782,797

(22) Filed: Feb. 13, 2001

(65) Prior Publication Data

US 2002/0153069 A1 Oct. 24, 2002

(51) Int. Cl.[7] ..... B22D 11/06; C22F 1/04

(52) U.S. Cl. ..... 148/551; 148/696; 148/692; 164/481

(58) Field of Search ..... 164/481, 431, 164/432; 148/551, 696, 692, 415, 437

(56) References Cited

U.S. PATENT DOCUMENTS 3,989,548 A 11/1976 Morris
4,126,487 A * 11/1978 Morris et al. ..... 148/2
4,671,985 A 6/1987 Rodriques et al.
5,380,379 A 1/1995 Maiwald et al.

FOREIGN PATENT DOCUMENTS

| | | |
|---|---|---|
| JP | 60200943 | 10/1985 |
| JP | 62250144 | 10/1987 |
| JP | 1034548 | 2/1989 |
| JP | H3-153835 | 7/1991 |
| WO | WO 98/45492 | * 10/1998 |

* cited by examiner

*Primary Examiner*—George Wyszomierski
*Assistant Examiner*—Janelle Combs Morillo
(74) *Attorney, Agent, or Firm*—Cooper & Dunham LLP

(57) ABSTRACT

An aluminum alloy foil is formed from an alloy containing about 1.2 to 1.7% by weight iron, about 0.4 to 0.8% by weight silicon and about 0.07 to 0.20% by weight manganese, with the balance aluminum and incidental impurities. The alloy is continuously strip cast, e.g. on a belt caster, to form a strip having a thickness of less than about 25 mm, which is then cold rolled to interanneal gauge followed by interannealing at a temperature of about 280 to 350° C. The interanneal strip is cold rolled to final gauge and further annealed to form the final foil product, having high strength and excellent quality.

13 Claims, 4 Drawing Sheets

IA @ 250°C IA @ 300°C IA @ 350°C

TB2-435 (1.5 Fe - 0.5 Si)

TB2-436 (1.5 Fe - 0.5 Si -0.1 Mn)

Final Anneal @ 250°C

Final Anneal @ 400°C

PRODUCTION OF HIGH STRENGTH ALUMINUM ALLOY FOILS

BACKGROUND OF THE INVENTION

This invention relates to the production of high strength aluminum alloy foil products. Specifically, it relates to a process for manufacturing a new aluminum alloy foil using a continuous belt casting process.

Thin gauge foils are generally prepared by casting an ingot of an aluminum alloy in a process known as DC or direct chill casting. The ingots are generally heated to a high temperature, hot rolled to a re-roll gauge thickness of between 1 and 10 mm, then cold rolled to a "foil-stock" gauge typically 0.2 to 0.4 mm thick. The strip is often subjected to an interanneal step during the cold rolling process. The "foil-stock" may be subject to further cold rolling operations, to produce a final foil thickness of about 5 to 150 microns.

There is a cost advantage to using continuous strip casting as the starting point in manufacture of such foils since homogenization prior to hot rolling is not required, and the amount of hot reduction to form re-roll gauges is greatly reduced. Where high volume continuous casting is required, twin belt casting is the preferred method of continuous casting. However, continuous strip casting processes apply different cooling conditions during solidification from those in DC casting, and there is an absence of a high temperature homogenization step prior to hot rolling. Consequently when continuous strip casting processes are used with alloys normally prepared by DC casting and homogenization, this results in the formation of different intermetallic species. In continuous strip casting, the cooling rate of the strip during casting is generally higher (in some cases much higher) than the cooling rate in large DC ingots. Thus, such alloys processed in a continuous strip casting process also result in foil stock which has a higher supersaturation of solute elements, and therefore has undesirable hardening and softening properties, resulting in difficulties in rolling the foil stock to the final gauge thickness and in controlling the properties of the final gauge produced.

There is a particularly strong interest in producing what are referred to as "ultra high strength foils", i.e. a class of foils having an ultimate tensile strength (UTS) level of 130 MPa or higher. This strength is much higher than the strength of common AA1xxx alloy foils (60–90 MPa) or that of higher strength AA8021-type alloy foils (90–120 MPa). In one method of production of ultra high strength foils, AA8006-type alloys are cast on a twin roll caster and the roll cast materials are processed following specifically tailored processing routes. An AA8006-type alloy has the nominal composition of less than 0.4% by weight silicon, 1.2 to 2.0% by weight percent iron and 0.3 to 1.0% by weight manganese, with the balance aluminum and usual impurities. When the same AA8006 alloy is cast on a belt caster, the resulting strip does not have the same microstructure as that of the twin roll cast strip. For instance, severe shell distortion occurs generating a wide variety of intermetallic sizes and concentrations that negatively affect microstructure control. Therefore, the final anneal cannot produce the desired structure. Thus, it has not been possible to produce ultra high strength foils using the belt casting route.

A process for producing high strength aluminum foil using twin roll casting is described in Furukawa Alum Japanese Patent JP1034548. That process used an aluminum alloy containing 0.8 to 2 wt. % Fe, 0.1 to 1 wt. % Si, 0.01 to 0.5 wt. % Cu, 0.01 to 0.5 wt. % Mg and 0.01 to 1 wt. % Mn. Ti and B were also included at grain refining levels. The alloy was twin roll cast to a thickness of 0.5 to 3 mm and rolled to foil. A heat treatment at 200 to 450° C. was also included.

In Mitsubishi, Japanese Patent Publication H3-153835 a fin material is described that was made from an Al—Fe—Si—Mn alloy. The alloy was cast to a thickness of 30 mm, hot rolled and cold rolled with interanneal, but with no final anneal.

Alcoa, U.S. Pat. No. 5,380,379 describes the production of a foil from an aluminum alloy containing about 1.35 to 1.6 wt. % iron, about 0.3 to 0.6 wt. % manganese, about 0.1 to 0.4 wt. % copper, about 0.05 to 0.1 wt. % titanium, about 0.01 to 0.02 wt. % boron, up to about: 0.2 wt. % silicon, 0.02 wt. % chromium, 0.005 wt. % magnesium and 0.05 wt. % zinc using a twin roll caster. The alloy was cast and then heat treated at a temperature of about 460 to 500° C. before cold rolling.

Another process for producing aluminum foil is described in Showa, Japanese Patent JP62250144. Here an aluminum alloy was used containing 0.7–1.8 wt. % Fe, 0.2 to 0.5 wt. % Si and 0.1 to 1.5 wt. % Mn. The procedure involved direct chill casting, homogenization and hot rolling prior to the cold roll step.

In Swiss Aluminum, U.S. Pat. No. 4,671,985 an aluminum foil is described containing 0 to 0.5 wt. % Si, 0.8 to 1.5 wt. % Fe and 0 to 0.5 wt. % Mn. After being strip cast it was hot rolled, followed by cold rolling without interanneal.

WO 98 45492 describes an aluminum foil made from an aluminum alloy containing 0.2 to 0.5 wt. % Si, 0.4 to 0.8 wt. % Fe, 0.1 to 0.3 wt. % Cu and 0.05 to 0.3 wt. % Mn. The alloy was continuously cast, cold rolled, interannealed at a temperature of 250 to 450° C., cold rolled to final gauge and final annealed at about 330° C.

It an object of the present invention to produce using continuous strip casting a novel high strength aluminum foil having properties equivalent to high strength foil produced by direct chill or twin roll casting of AA8006.

It is a further objective to produce a high strength alloy by a continuous casting route capable of high volume production rates.

SUMMARY OF THE INVENTION

In accordance with the present invention, the problem of producing a high strength aluminum alloy foil using a continuous strip caster has been solved by way of a new alloy composition and a new processing route. Thus, the alloy that is used is one containing 1.2 to 1.7 wt. % Fe, 0.4 to 0.8 wt. % Si and 0.07 to 0.20 wt. % Mn, with the balance aluminum and incidental impurities. The above alloy is then cast in a continuous strip caster to a strip thickness of less than about 25 mm, preferably about 5 to 25 mm, followed by cold rolling to interanneal gauge. The interannealing is carried out at a temperature in the range of about 280 to 350° C., followed by cold rolling to final gauge and final anneal.

The interanneal is typically continued for about 2 to 8 hours, and the final anneal is preferably at a temperature of about 250 to 300° C. for about 1 to 6 hours. The continuous strip casting is preferably conducted on a belt caster and the interanneal gauge is typically about 0.5 to 3.0 mm.

In the above alloy, the Si content was increased and the Mn content was decreased as compared to the traditional AA8006 alloy. This solved local non-uniform cooling problems encountered with AA8006 alloy and a stable recovered structure was obtained by a carefully selected interanneal temperature range. The grain size of the stable recovered structure is typically in the 1 to 7 $\mu$m range.

Fe in the alloy is a strengthening element, forming intermetallic particles during casting (which typically break down into smaller particles during rolling) and dispersoids during subsequent heat treatments (typically fine particles 0.1 micron or less in size) during the process. These particles stabilize the subgrains in the final anneal process. If Fe is less than 1.2 wt. %, the effect of Fe is not sufficient to make a strong foil, and if Fe exceeds 1.7 wt. %, there is a danger of forming large primary intermetallic particles during casting which are harmful for rolling and the quality of the foil products.

Si in the alloy improves castability in the casting stage and the uniformity of the cast structure. It also accelerates the precipitation of dissolved solute elements during the annealing stage. If Si is less than 0.4 wt. %, casting is difficult and the cast structure becomes less uniform. If the Si is more than 0.8 wt. %, the recrystallization temperature is lowered and the final anneal temperature range becomes too narrow.

Mn in the alloy is required to control the recovery process and hence the grain size of the foil after the final anneal. If Mn is less than 0.07 wt. %, the effect of the element is insufficient and a stable recovered structure cannot be obtained. If the Mn exceeds 0.20 wt. %, the ductility of the material after the final anneal becomes too low.

Although the continuously cast strip may have an as-cast thickness of up to 25 mm and be hot rolled to a gauge of about 1 to 5 mm before cold rolling to the intermediate gauge at which interannealing takes place, according to a preferred procedure, a strip is continuously cast to a thickness of no more than 10 mm, most preferably 5 to 10 mm. A strip of this thickness does not require any hot rolling prior to cold rolling. The strip is preferably brought to a thickness of about 0.5 to 0.8 mm during cold rolling.

In is preferred that the strip be continuously cast in a belt caster. Belt casting is a form of continuous strip casting carried out between moving flexible and cooled belts. Although the belts may exert a force on the strip to ensure adequate cooling, preferably the force is insufficient to compress the strip while it is solidifying. Typically a belt caster will cast strips less than about 25 mm thick and preferably greater than about 5 mm thick. The cooling rate for casting alloys of the present invention generally lies between about 20 and 300° C./sec.

The continuously cast strip must not be homogenized before any subsequent rolling step as this has the effect of lowering the UTS obtainable in the final foil material.

EXAMPLE 1

Figure 1:
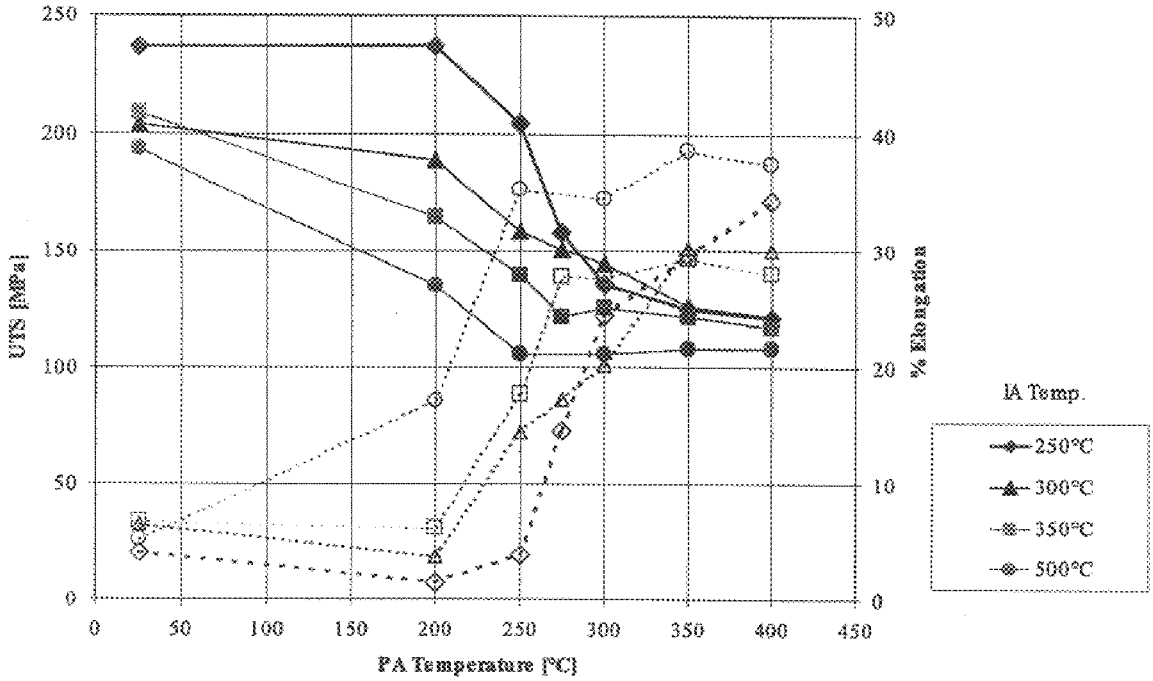
FIG. 1 is a graph relating strength and elongation to partial anneal temperature for an alloy of the invention.
Figure 2:
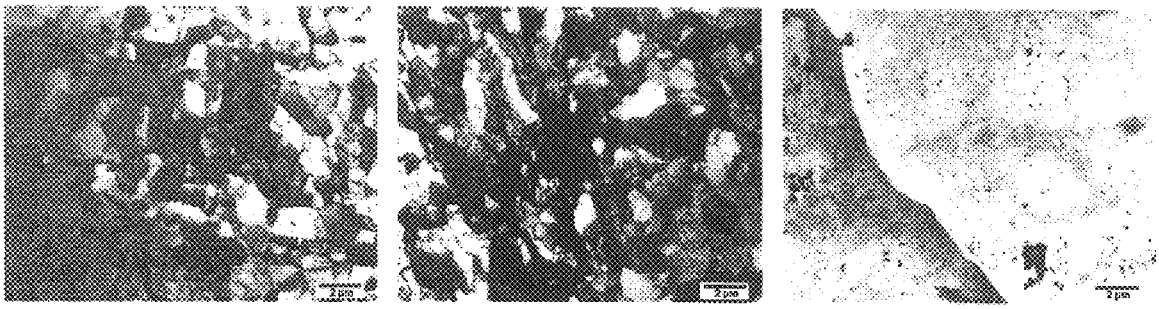
FIG. 2 shows transmission electron micrographs of foils produced from alloys of the invention with variable interanneal temperatures and a final anneal temperature of 300° C.
Figure 3:
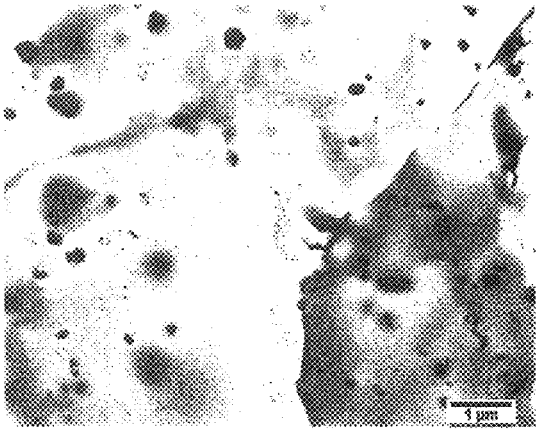
FIG. 3 shows transmission electron micrographs of foils produced from different alloys of the invention with an interanneal temperature of 300° C. and a final anneal temperature of 300° C.
Figure 3:
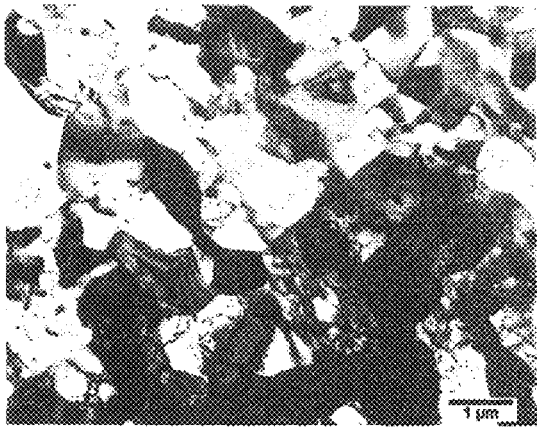
Figure 4:
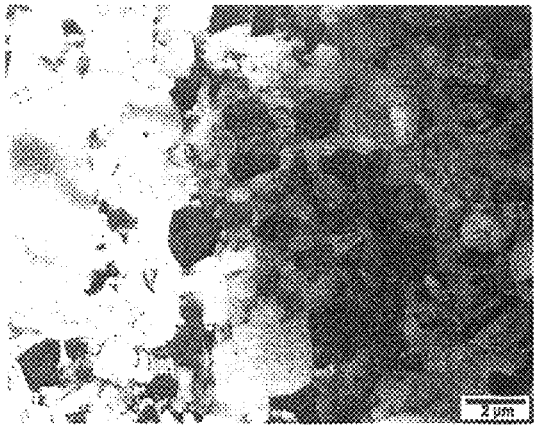
FIG. 4 shows transmission electron micrographs of foils produced from an alloy of the invention with an interanneal temperature of 300° C. and varying final anneal temperatures.
Figure 4:
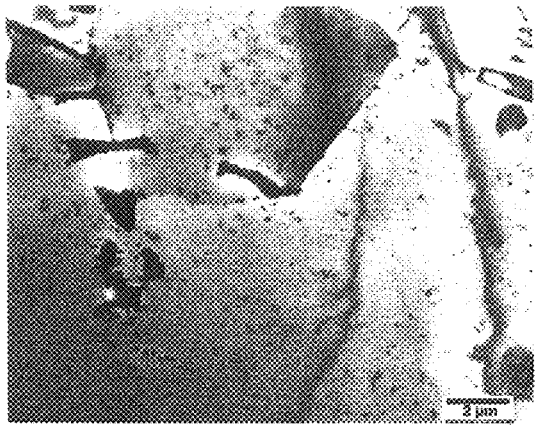

A series of tests were conducted on a laboratory belt caster. The alloys used are shown in Table 1 below:

TABLE 1

| Cast | Chemical Composition (wt. %) | | | |
|---|---|---|---|---|
| No. | Fe | Si | Mn | Comment |
| 1 | 1.54 | 0.47 | — | Mn too low |
| 2 | 1.55 | 0.46 | 0.09 | Within inventive range |
| 3 | 1.16 | 0.48 | 0.20 | Iron too low |
| 4 | 1.48 | 0.78 | 0.10 | Within inventive range |
| 5 | 1.47 | 0.25 | 0.10 | Si too low |
| 6 | 0.91 | 0.45 | 0.09 | Fe too low |

The as-cast strips were nominally 7.3 mm thick, and all casts were free of shell distortion. Casting was done on a twin belts caster with heat fluxes in the range 1.5 to 3.8 $MW/m^2$. This corresponds to an average cooling rate through the cast strip of between 150 and 420° C./s.

Samples of all as-cast strips were taken, cut, polished and anodized in a sulphuric acid solution. The results showed that alloys 1,2,3,4,and 6 were structurally homogeneous, but that alloy 5 showed a non-homogeneous cast structure (different intermetallic particles were formed during solidification from one location to another). This alloy was therefore not processed further.

To examine the effect of interanneal practice and alloy composition on the partial anneal response of the materials in the final annealing step, in particular to see if the materials develop a stable recovery regime in the temperature range 250 to 300° C., all cast strips (except for Cast No. 5) were processed and tensile tested as follows:

As-cast (7.3 mm)

Cold rolled to 3 mm

Interannealed at 250 to 500° C. for 4 hours

Cold rolled to 0.3 mm

Final annealed at 250 to 400° C., and tensile tested

A typical example of the test results for Cast No. 2 is given in FIG. 1. This shows partial anneal response curves of the alloy which was interannealed at 4 different temperatures. It is seen that the partial anneal response is very dependent on the interanneal practice used. When the interanneal temperature was lower than 250° C. or higher than 350° C., the material did not develop any stable recovery regime, i.e., the tensile properties changed rapidly in the recovery temperature range. On the other hand, when the material was interannealed at 300° C., it developed a fairly stable recovery regime in the final anneal stage, i.e. the UTS values in the 250 to 300° C. range did not change rapidly.

The tensile properties for a variety of alloys after final annealing at 250° C. and 300° C., are shown in Table 2 below:

TABLE 2

| Cast No. | Interanneal Temp. (° C.) | Final Anneal Temp. (° C.) | UTS (MPa) | Elong. (%) | UTS drop/MPa |
|---|---|---|---|---|---|
| 1 | 250 | 250 | 179.9 | 8.5 | 60 |
| | | 300 | 120.2 | 35.0 | |
| 1 | 300 | 250 | 144.1 | 19.5 | 28 |
| | | 300 | 116.6 | 32.2 | |
| 1 | 350 | 250 | 117.6 | 30.7 | 2 |
| | | 300 | 115.6 | 33.2 | |

TABLE 2-continued

| Cast No. | Interanneal Temp. (° C.) | Final Anneal Temp. (° C.) | UTS (MPa) | Elong. (%) | UTS drop/MPa |
|---|---|---|---|---|---|
| 2 | 250 | 250 | 204.3 | 3.8 | 69 |
| | | 300 | 135.3 | 24.4 | |
| 2 | 300 | 250 | 158.3 | 14.5 | 14 |
| | | 300 | 144.2 | 20.2 | |
| 2 | 350 | 250 | 139.2 | 17.7 | 14 |
| | | 300 | 125.5 | 27.7 | |
| 3 | 250 | 250 | 192.6 | 4.0 | 36 |
| | | 300 | 156.4 | 14.9 | |
| 3 | 300 | 250 | 170.8 | 10.0 | 13 |
| | | 300 | 158.0 | 15.9 | |
| 3 | 350 | 250 | 162.2 | 12.9 | 23 |
| | | 300 | 139.1 | 19.2 | |
| 4 | 250 | 250 | 189.2 | 9.1 | 46 |
| | | 300 | 142.8 | 24.7 | |
| 4 | 300 | 250 | 159.5 | 16.3 | 11 |
| | | 300 | 148.5 | 23.4 | |
| 4 | 350 | 250 | 152.6 | 18.1 | 17 |
| | | 300 | 135.9 | 23.2 | |
| 6 | 300 | 250 | 152.4 | 11.9 | 20 |
| | | 300 | 132.5 | 19.7 | |

The UTS drop shown in Table 2 is the strength decrease that occurs when the final anneal temperature is increased 250 to 300° C. This is an indication of the strength stability during the final anneal in the temperature range. A good quality high strength foil requires not only a high strength in the final product form, but also a good ductility good strength stability in the final anneal temperature range. Typically the strength after the final anneal should be higher than 130 MPa, the ductility higher than 13% tensile elongation and the UTS drop less than 25 MPa over the 50° C. temperature range.

The data in Table 2 shows that Cast No. 1 (an alloy without Mn) does not meet the good quality foil property criteria under any processing condition primarily because the strength is too low and the material does not possess the stable recovery regime in the final anneal stage, Cast No. 2 (Fe, Si and Mn within the inventive range) makes a good quality foil when the material is annealed at about 300° C., Cast No. 3 (Fe only slightly below the minimum) nearly meets the criteria when the material is interannealed at 300° C., Cast No. 4 meets the criteria with interanneals at both 300° C. and 250° C., and Cast No. 6 (low Fe) does not produce good quality foil mainly because of the low ductility.

Thus the examples in Table 2 illustrate that a good quality high strength foil can be produced with the alloy composition and interanneal practice of the present invention.

What is claimed is:

1. A process for producing a high-strength aluminum foil using a continuous strip caster, comprising the steps of:

(a) providing an alloy containing in percentage by weight about 1.2 to 1.7% iron, about 0.4 to 0.8% silicon, about 0.07 to 0.20% manganese and the balance being aluminum and incidental impurities, (b) casting the alloy on a continuous strip caster to form a cast strip having an as-cast thickness of less than about 25 mm, (c) cold rolling the cast strip to interanneal gauge, (d) interannealing the strip at a temperature of about 280 to 350° C., (e) cold rolling the interannealed strip to final gauge, and (f) subjecting the final gauge strip to a final anneal.

2. The process according to claim 1 wherein the continuously cast strip has an as-cast thickness between about 5 to 10 mm.

3. A process for producing a high strength aluminum foil using a belt caster, comprising the steps of:

(a) providing an alloy containing in percentage by weight about 1.2 to 1.7% iron, about 0.4 to 0.8% silicon, about 0.07 to 0.20% manganese and the balance being aluminum and incidental impurities, (b) continuously casting the alloy on a twin belt caster to form a cast strip having an as-cast thickness of less than about 25 mm, (c) cold rolling the cast strip to interanneal gauge, (d) interannealing the strip at a temperature of about 280 to 350° C., (e) cold rolling the interannealed strip to final gauge, and (f) subjecting the final gauge strip to a final anneal.

4. The process according to claim 1 wherein the continuously cast strip has an as-cast thickness between about 5 to 25 mm and the as-cast strip is hot rolled prior to cold rolling.

5. The process according to claim 1 wherein the cast strip is cold rolled to a thickness of about 0.5 to 3.0 mm before interannealing.

6. The process according to claim 5 wherein the cast strip is cold rolled to a thickness of about 0.5 to 0.8 mm before interannealing.

7. The process according to claim 1 wherein the interanneal at 280 to 350° C. is conducted for about 2 to 8 hours.

8. The process according to claim 7 wherein the interanneal is conducted at a temperature of about 300° C.

9. The process according to claim 1 wherein the final anneal is at a temperature of about 250 to 300° C.

10. The process according to claim 9 wherein the final anneal at 250 to 300° C. is conducted for about 1 to 6 hours.

11. The process according to claim 3 wherein the final anneal is at a temperature of about 250 to 300° C.

12. The process according to claim 11 wherein said foil at final gauge has an ultimate tensile strength (US) greater than 130 MPa after annealing at a temperature of 300° C.

13. The process according to claim 12 wherein the foil during final anneal loses less than 25 MPa US for an anneal temperature increase from 250 to 300° C.

* * * * *